US010313785B2

(12) United States Patent
Lang et al.

(10) Patent No.: US 10,313,785 B2
(45) Date of Patent: Jun. 4, 2019

(54) SOUND PROCESSING NODE OF AN ARRANGEMENT OF SOUND PROCESSING NODES

(71) Applicant: Huawei Technologies Co., Ltd., Shenzhen (CN)

(72) Inventors: Yue Lang, Beijing (CN); Wenyu Jin, Munich (DE); Thomas Sherson, Delft (NL); Richard Heusdens, Delft (NL); Willem Bastiaan Kleijn, Delft (NL)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 15/940,635

(22) Filed: Mar. 29, 2018

(65) Prior Publication Data

US 2018/0270573 A1 Sep. 20, 2018

Related U.S. Application Data

(63) Continuation of application No. PCT/EP2015/073907, filed on Oct. 15, 2015.

(51) Int. Cl.
*H04R 3/00* (2006.01)
*H04R 1/40* (2006.01)
(Continued)

(52) U.S. Cl.
CPC ..... *H04R 3/005* (2013.01); *G10L 21/0208* (2013.01); *H04R 1/406* (2013.01); *G10L 21/0232* (2013.01); *G10L 2021/02166* (2013.01); *H04R 2201/401* (2013.01); *H04R 2420/07* (2013.01)

(58) Field of Classification Search
CPC .. H04R 3/005; H04R 1/406; H04R 2201/401; H04R 2420/07; G10L 21/0232; G10L 2021/02166; G10L 21/0208
See application file for complete search history.

(56) References Cited

U.S. PATENT DOCUMENTS

2013/0017855 A1* 1/2013 Hui ..... H04W 16/28 455/522
2014/0314251 A1* 10/2014 Rosca ..... H04R 3/005 381/92

OTHER PUBLICATIONS

Bertrand et al., "Distributed Node-Specific LCMV Beamforming in Wireless Sensor Networks," IEEE Transactions on Signal Processing, vol. 60, No. 1, pp. 233-246, XP011389753, Institute of Electrical and Electronics Engineers, New York, New York (Jan. 2012).
(Continued)

*Primary Examiner* — Andrew L Sniezek
(74) *Attorney, Agent, or Firm* — Leydig, Voit & Mayer, Ltd.

(57) ABSTRACT

A sound processing node for an arrangement of sound processing nodes is disclosed. The sound processing nodes being configured to receive a plurality of sound signals, wherein the sound processing node comprises a processor configured to determine a beamforming signal on the basis of the plurality of sound signals weighted by a plurality of weights, wherein the processor is configured to determine the plurality of weights using a transformed version of a linearly constrained minimum variance approach, the transformed version of the linearly constrained minimum variance approach being obtained by applying a convex relaxation to the linearly constrained minimum variance approach.

15 Claims, 5 Drawing Sheets

(51) Int. Cl.

| | |
|---|---|
| ***G10L 21/0208*** | (2013.01) |
| *G10L 21/0216* | (2013.01) |
| *G10L 21/0232* | (2013.01) |

(56) References Cited

OTHER PUBLICATIONS

Lu et al., "A Novel Adaptive Phase-Only Beamforming Algorithm Based on Semidefinite Relaxation," 2013 IEEE International Symposium on Phased Array Systems and Technology, IEEE, XP032562772, pp. 617-621, Institute of Electrical and Electronics Engineers, New York, New York (Oct. 2013).

Jiang et al., "Robust Beamforming by Linear Programming", IEEE Transactions on Signal Processing, vol. 62, No. 7, pp. 1834-1849, XP011542739, Institute of Electrical and Electronics Engineers, New York, New York, (Apr. 1, 2014).

Yukawa et al.,"Dual-Domain Adaptive Beamformer Under Linearly and Quadratically Constrained Minimum Variance", IEEE Transactions on Signal Processing, vol. 61, No. 11, pp. 2874-2886, XP011509778, Institute of Electrical and Electronics Engineers, New York, New York, (Jun. 1, 2013).

Bertrand et al.,"Distributed LCMV Beamforming in a Wireless Sensor Network With Single-Channel Per-Node Signal Transmission", IEEE Transactions on Signal Processing, vol. 61, No. 13, pp. 3447-3459, XP011514756, Institute of Electrical and Electronics Engineers, New York, New York (Jul. 1, 2013).

Bertrand et al.,"Distributed LCMV Beamforming in Wireless Sensor Networks with Node-Specific Desired Signals," 2011 IEEE International Conference on Acoustics, Speech and Signal Processing: (ICASSP 2011), pp. 2668-2671,XP032001361, Institute of Electrical and Electronics Engineers, New York, New York (May 2011).

Ehrenberg et al., "Sensitivity Analysis of MVDR and MPDR Beamformers," 2010 IEEE 26th Convention of Electrical and Electronics Engineers in Israel, Institute of Electrical and Electronics Engineers, New York, New York (2010).

Li et al., "On Robust Capon Beamforming and Diagonal Loading," IEEE Transactions on Signal Processing, vol. 51, No. 7, pp. 1702-1715, Institute of Electrical and Electronics Engineers, New York, New York (Jul. 2003).

Cox et al., "Robust Adaptive Beamforming," IEEE Transactions on Acoustics, Speech, and Signal Processing, vol. 35, Issue: 10, pp. 1365-1376, Institute of Electrical and Electronics Engineers, New York, New York (Oct. 1987).

Lorenz et al., "Robust Minimum Variance Beamforming," IEEE Transactions on Signal Processing, vol. 53, No. 5, pp. 1684-1696, Institute of Electrical and Electronics Engineers, New York, New York (May 2005).

Zhang et al., "Bi-Alternating Direction Method of Multipliers Over Graphs.," IEEE ICASSP 2015, pp. 3571-3575, Institute of Electrical and Electronics Engineers, New York, New York (2015).

Boyd et al., "Distributed Optimization and Statistical Learning via the Alternating Direction Method of Multipliers," Machine Learning vol. 3, No. 1, Foundations and Trends (2011).

Huesdens et al., "Distributed MVDR Beamforming for (Wireless) Microphone Networks Using Message Passing," International Workshop on Acoustic Signal Enhancement 2012, Aachen (Sep. 4-6, 2012).

O'Connor et al., "Diffusion-Based Distributed MVDR Beamformer," IEEE International Conference on Acoustic, Speech and Signal Processing (ICASSP), pp. 810-814, Institute of Electrical and Electronics Engineers, New York, New York (2014).

Markovich-Golan et al., "Optimal distributed minimum-variance beamforming approaches for speech enhancement in wireless acoustic sensor networks," Signal Processing, Elsevier, (Jul. 2014).

* cited by examiner

SOUND PROCESSING NODE OF AN ARRANGEMENT OF SOUND PROCESSING NODES

CROSS-REFERENCE TO RELATED APPLICATIONS

This application is a continuation of International Application No. PCT/EP2015/073907, filed on Oct. 15, 2015, the disclosure of which is hereby incorporated by reference in its entirety.

TECHNICAL FIELD

Generally, the present application relates to audio signal processing. In particular, the present application relates to a sound processing node of an arrangement of sound processing nodes, a system comprising a plurality of sound processing nodes and a method of operating a sound processing node within an arrangement of sound processing nodes.

BACKGROUND

In the field of speech processing, one of the major challenges faced by engineers is how to maintain the quality of speech intelligibility in environments containing noise and interference. This occurs in many practical scenarios such as using a cellphone on a busy street or the classic example of trying to understand someone at a cocktail party. A common way to address this issue is by exploiting spatial diversity of both the sound sources and multiple recording devices to favor particular directions of arrival over others, a process referred to as beam-forming.

Whilst more traditional beam-formers, for acoustic processes, are comprised of physically connected arrays of microphones, the improvement in both sensor and battery technologies over the last few decades has made it practical to also use wireless sensor networks (WSNs) for the same purpose. Such systems are comprised of a large number of small, low cost sound processing nodes which are capable of both recording incoming acoustic signals and then transmitting this information throughout the network.

The use of such wireless sound processing nodes makes it possible to deploy varying sizes of networks without the need to redesign the hardware for each application. However, unlike dedicated systems, such WSNs have their own set of particular design considerations. The major drawback of WSNs is that, due to the decentralized nature of data collection, there is no one location in which the beam-former output can be calculated. This also affects the ability of WSNs to estimate covariance matrices which are needed in the design of statistically optimal beamforming methods.

A simple approach to solving this issue is to add an additional central point or fusion center to which all data is transmitted for processing. This central point though suffers from a number of drawbacks. Firstly, if it should fail, the performance of the entire network is compromised which means that additional costs need to be taken to provide redundancy to address this. Secondly, the specifications of the central location, such as memory requirements and processing power, vary with the size of the network and thus should be over specified to ensure that the network can operate as desired. And thirdly, for some network topologies such a centralized system can also introduce excessive transmission costs, which can cause the depletion of each node's battery life.

An alternative to these centralized topologies is to exploit the computation power of the nodes themselves and to solve the same problem from within the network. Such distributed topologies have the added benefit of removing the single point of failure whilst providing computation scalability, as adding additional nodes to the network also increases the processing power available. The main challenge with distributed approaches stems back to the lack of a central point where all system data is available which requires the design of alternative and typically iterative algorithms.

Although a number of approaches for providing a distributed beamforming algorithm already exist in the literature, they are not without their limitations. The most notable of these is that hardware based requirements, such as memory use, often still scale with the size of the network making it impractical to deploy these algorithms using the same hardware platform in ad-hoc or varying size networks. Such a constraint relates to the need of these "distributed" algorithms to have access to some form of global data, be it in a compressed form or not. Thus there is a current need in the art for a truly distributed, statistically optimal beamforming approach, in particular for use in wireless sensor networks.

SUMMARY

It is an object of the application to provide a distributed, statistically optimal beamforming approach, in particular for use in wireless sensor networks.

The foregoing and other objects are achieved by the subject matter of the independent claims. Further implementation forms are apparent from the dependent claims, the description and the figures.

According to a first aspect, the application relates to a sound processing node for an arrangement of sound processing nodes, the sound processing nodes being configured to receive a plurality of sound signals, wherein the sound processing node comprises a processor configured to determine a beamforming signal on the basis of the plurality of sound signals weighted by a plurality of weights, wherein the processor is configured to determine the plurality of weights using a transformed version of a linearly constrained minimum variance approach, the transformed version of the linearly constrained minimum variance approach being obtained by applying a convex relaxation to the linearly constrained minimum variance approach.

Using a convex relaxed version of the linearly constrained minimum variance approach allows determining the plurality of weights defining the beamforming signal by each sound processing node of the arrangement of sound processing nodes in a fully distributed manner.

In an implementation form, the sound processing node can comprise a single microphone configured to receive a single sound signal or a plurality of microphones configured to receive a plurality of sound signals. Generally, the number of sound signals received by the sound processing node determines the number of weights. The plurality of weights are usually complex valued, i.e. including a time/phase shift. In an implementation form, the processor is configured to determine the plurality of weights for a plurality of different frequency bins. The linearly constrained minimum variance approach minimizes the noise power of the beamforming signal, while adhering to linear constraints which maintain desired responses for the plurality of sound signals.

In a first possible implementation form of the sound processing node according to the first aspect, the linearly constrained minimum variance approach is a robust linearly constrained minimum variance approach, wherein the processor is configured to determine the plurality of weights using a transformed version of the robust linearly constrained minimum variance approach parametrized by a parameter $\alpha$, wherein the parameter $\alpha$ provides a tradeoff between the minimization of the magnitude of the weights and the energy of the beamforming signal.

This implementation form allows the processor to provide robust values for the plurality of weights by allowing an adjustment of the parameter $\alpha$.

In a second possible implementation form of the sound processing node according to the first implementation form of the first aspect, the processor is configured to determine the plurality of weights using the transformed version of the robust linearly constrained minimum variance approach on the basis of the following equation and constraints:

$$\min \sum_{i\in V}\sum_{l=1}^{M}\frac{1}{2NM}t_i^{(l)*}t_i^{(l)}+\frac{\alpha}{2}w_i^H w_i$$

$$\text{s.t. } \sum_{i\in V}D_i^{(p)H}\ w_i=s^{(p)}\ \forall\ p=1,\ldots,P$$

$$\sum_{i\in V}t_i^{(l)}=\sum_{i\in V}NY_i^{(l)H}w_i\ \forall\ l=1,\ldots,M,$$

wherein $w_i$ denotes the i-th weight of the plurality of weights, $Y_i^{(l)}$ denotes the vector of sound signals received by i-th sound processing node in the frequency domain, V denotes the set of all sound processing nodes, M denotes the total number of microphones of all sound processing nodes, i.e. $M=\Sigma_{i=1}^{N}m_i$, N denotes the total number of sound processing nodes, $D_i^{(p)}$ defines a channel vector associated with a p-th direction, P denotes the total number of directions and $s^{(p)}$ denotes the desired response for the p-th direction.

This implementation form allows for an efficient determination of the plurality of weights defining the beamforming signal by the processor of the sound processing node.

In a third possible implementation form of the sound processing node according to the first implementation form of the first aspect, the processor is configured to determine the plurality of weights using a further transformed version of the linearly constrained minimum variance approach, the further transformed version of the linearly constrained minimum variance approach being obtained by further transforming the transformed version of the linearly constrained minimum variance approach to the dual domain.

By exploiting strong duality this implementation form allows for an efficient determination of the plurality of weights defining the beamforming signal by the processor of the sound processing node.

In a fourth possible implementation form of the sound processing node according to the third implementation form of the first aspect, the processor is configured to determine the plurality of weights using the further transformed version of the linearly constrained minimum variance approach on the basis of the following equation using the dual variable A:

$$\min \sum_{i\in V}\left(\frac{1}{2}\lambda^H(B_i^H A_i^{-1}B_i)\lambda-\lambda^H C\right),$$

wherein the plurality of weights $w_i$ are defined by a vector $y_i$ defined by the following equation:

$$y_i t_i^{(1)},t_i^{(2)},\ldots,t_i^{(M)},w_i^{(1)},w_i^{(2)},\ldots,w_i^{(m_i)}]^T, \tag{2}$$

wherein $$t_j^{(l)}=\Sigma_{i\in V}Y_i^{(l)H}w_i,$$

$Y_i^{(l)}$ denotes the vector of sound signals received by i-th sound processing node in the frequency domain, V denotes the set of all sound processing nodes, $m_i$ denotes the number of microphones of the i-th sound processing node, and the dual variable $\lambda$ is related to the vector $y_i$ by means of the following equation:

$$y_i^*=A_i^{-1}B_i^*\lambda^*$$

and wherein $A_i$, $B_i$ and C are defined by the following equations:

$$A_i=\text{diag}\left(\left[\frac{1}{NM},\frac{1}{NM},\ldots,\frac{1}{NM},\alpha,\alpha,\ldots,\alpha\right]^T\right)$$

$$B_i=\begin{pmatrix}-1 & 0 & \cdots & 0 & 0 & \cdots & 0\\ 0 & -1 & \cdots & 0 & 0 & \cdots & 0\\ \vdots & \vdots & \ddots & \vdots & \vdots & \ddots & \vdots\\ 0 & 0 & \cdots & -1 & 0 & \cdots & 0\\ NY_i^{(1)} & NY_i^{(2)} & \cdots & NY_i^{(m_i)} & D_i^{(1)} & \cdots & D_i^{(P)}\end{pmatrix}$$

$$C=\left[0,0,\ldots,0,\frac{s^{(1)}}{N},\frac{s^{(2)}}{N},\ldots,\frac{s^{(P)}}{N}\right]^T$$

wherein

N denotes the total number of sound processing nodes,

M denotes the total number of microphones of all sound processing nodes, i.e. $M=\Sigma_{i=1}^{N}m_i$, $D_i^{(p)}$ defines a channel vector associated with a p-th direction, P denotes the total number of directions and $s^{(p)}$ denotes the desired response for the p-th direction.

This implementation form allows for an efficient determination of the plurality of weights defining the beamforming signal by the processor of the sound processing node, because the optimal $\lambda$ can be determined by inverting a (M+P) dimensional matrix which, for large arrangements of sound processing nodes, is much smaller than the N dimension matrix needed by conventional approaches.

In a fifth possible implementation form of the sound processing node of the third implementation form of the first aspect, the processor is configured to determine the plurality of weights using the further transformed version of the linearly constrained minimum variance approach on the basis of the following equation and the following constraint using the dual variable $\lambda$:

$$\min \sum_{i\in V}\left(\frac{1}{2}\lambda_i^H(B_i^H A_i^{-1}B_i)\lambda_i-\lambda_i^H C\right)$$

$$\text{s.t. } D_{ij}\lambda_i+D_{ji}\lambda_j=0\ \forall\ (i,j)\in E,$$

wherein $\lambda_i$ defines a local estimate of the dual variable $\lambda$ at the i-th sound processing node, $D_{ij}=-D_{ji}=\pm I$ with I denoting the identity matrix, E defines the set of sound processing nodes defining an edge of the arrangement of sound processing nodes and the plurality of weights $w_i$ are defined by a vector $y_i$ defined by the following equation:

$$y_i t_i^{(1)}, t_i^{(2)}, \ldots, t_i^{(M)}, w_i^{(1)}, w_i^{(2)}, \ldots, w_i^{(m_i)}]^T, \quad (2)$$

wherein $$t_j^{(l)}=\Sigma_{i\in V} Y_i^{(l)H} w_i,$$

$Y_i^{(l)}$ denotes the vector of sound signals received by i-th sound processing node in the frequency domain, V denotes the set of all sound processing nodes, $m_i$ denotes the number of microphones of the i-th sound processing node, and the dual variable $\lambda$ is related to the vector $y_i$ by means of the following equation:

$$y_i^*=A_i^{-1}B_i^*\lambda^*$$

and wherein $A_i$, $B_i$ and C are defined by the following equations:

$$A_i = \mathrm{diag}\left(\left[\frac{1}{NM}, \frac{1}{NM}, \ldots, \frac{1}{NM}, \alpha, \alpha, \ldots, \alpha\right]^T\right)$$

$$B_i = \begin{pmatrix} -1 & 0 & \cdots & 0 & 0 & \cdots & 0 \\ 0 & -1 & \cdots & 0 & 0 & \cdots & 0 \\ \vdots & \vdots & \ddots & \vdots & \vdots & \ddots & \vdots \\ 0 & 0 & \cdots & -1 & 0 & \cdots & 0 \\ NY_i^{(1)} & NY_i^{(2)} & \cdots & NY_i^{(m_i)} & D_i^{(1)} & \cdots & D_i^{(P)} \end{pmatrix}$$

$$C = \left[0, 0, \ldots, 0, \frac{s^{(1)}}{N}, \frac{s^{(2)}}{N}, \ldots, \frac{s^{(P)}}{N}\right]^T$$

wherein

N denotes the total number of sound processing nodes,

M denotes the total number of microphones of all sound processing nodes, i.e. $M=\Sigma_{i=1}^{N} m_i$, $D_i^{(p)}$ defines a channel vector associated with a p-th direction, P denotes the total number of directions and $s^{(p)}$ denotes the desired response for the p-th direction.

This implementation form is especially useful for arrangement of sound processing nodes defining an ad-hoc network of sound processing nodes, as new sound processing nodes can be added with only some of the rest of the nodes of the network having to be updated.

In a sixth possible implementation form of the sound processing node according to the fifth implementation form of the first aspect, the processor is configured to determine the plurality of weights on the basis of a distributed algorithm, in particular the primal dual method of multipliers.

This implementation form allows for a very efficient computation of the plurality of weights by the processor of a sound processing node of an arrangement of sound processing nodes defining a cyclic network topology.

In a seventh possible implementation form of the sound processing apparatus according to the sixth implementation form of the first aspect, the processor is configured to determine the plurality of weights on the basis of a distributed algorithm by iteratively solving the following equations:

$$\lambda_{i,k+1} = \left(B_i^H A_i^{-1} B_i + \sum_{j\in N(i)} R_{pij}\right)^{-1}\left(C + \sum_{j\in N(i)} (D_{ij}\varphi_{ji,k} + R_{pij}\lambda_{j,k})\right)$$

$$\varphi_{ij,k+1} = \varphi_{ji,k} - R_{pij}(D_{ij}\lambda_{i,k+1} + D_{ji}\lambda_{j,k})$$

wherein $\mathcal{N}$ (i) defines the set of sound processing nodes neighboring the i-th sound processing node and $R_{pij}$ denotes a positive definite matrix that determines the convergence rate and that is defined $\forall(i, j)\in E$ by the following equation:

$$R_{pij} = \frac{1}{N}(B_i + B_j)^H A_i^{-1}(B_i + B_j).$$

This implementation form allows for an efficient computation of the plurality of weights by the processor of a sound processing node of an arrangement of sound processing nodes defining a cyclic network topology. In an implementation form, the sound processing node can be configured to distribute the variables $\lambda_{i,k+1}$ and $\varphi_{ij,k+1}$ to neighboring sound processing nodes via any wireless broadcast or directed transmission scheme.

In an eighth possible implementation form of the sound processing node according to the fifth implementation form of the first aspect, the processor is configured to determine the plurality of weights on the basis of a min-sum message passing algorithm.

This implementation form allows for an efficient computation of the plurality of weights by the processor of a sound processing node of an arrangement of sound processing nodes defining an acyclic network topology.

In a ninth possible implementation form of the sound processing node according to the eighth implementation form of the first aspect, the processor is configured to determine the plurality of weights on the basis of a min-sum message passing algorithm using the following equation:

$$\underset{\lambda_i}{\mathrm{argmin}}\left(\frac{1}{2}\lambda_i^H\left(B_i^H A_i^{-1} B_i + \sum_{j\in N(i)} m_{ji}\right)\lambda_i - N\lambda_i^H C\right),$$

wherein $m_{ji}$ denotes a message received by the sound processing node i from another sound processing node j and wherein the message $m_{ji}$ is defined by the following equation:

$$m_{ji} = B_j^H A_j^{-1} B_j + \sum_{k\in N(j), k\neq i} m_{kj}.$$

wherein $\mathcal{N}$ (j) defines the set of sound processing nodes neighboring the j-th sound processing node.

This implementation form allows for a very efficient computation of the plurality of weights by the processor of a sound processing node of an arrangement of sound processing nodes defining an acyclic network topology. In an implementation form, the sound processing node can be configured to distribute the message $m_{ji}$ to neighboring sound processing nodes via any wireless broadcast or directed transmission scheme.

In a tenth possible implementation form of the sound processing node according to the first aspect as such or any one of the first to ninth possible implementation form thereof, the linearly constrained minimum variance approach is based on a covariance matrix R and wherein the processor is configured to approximate the covariance matrix R using an unbiased covariance of the plurality of sound signals.

This implementation form allows for a distributed estimation of the covariance matrix, for instance, in the presence of time varying noise fields.

In an eleventh possible implementation form of the sound processing node according to the tenth implementation form of the first aspect, the unbiased covariance of the plurality of sound signals is defined by the following equation:

$$Q = \frac{1}{M}\sum_{l=1}^{M} Y^{(l)}Y^{(l)H},$$

wherein $Y_i^{(l)}$ denotes the vector of sound signals received by i-th sound processing node in the frequency domain and M denotes the total number of microphones of all sound processing nodes.

According to a second aspect the application relates to a sound processing system comprising a plurality of sound processing nodes according to the first aspect, wherein the plurality of sound processing nodes are configured to exchange variables for determining the plurality of weights using a transformed version of the linearly constrained minimum variance approach.

According to a third aspect the application relates to a method of operating a sound processing node of an arrangement of sound processing nodes, the sound processing nodes being configured to receive a plurality of sound signals. The method comprises determining a beamforming signal on the basis of the plurality of sound signals weighted by a plurality of weights by determining the plurality of weights using a transformed version of a linearly constrained minimum variance approach, the transformed version of the linearly constrained minimum variance approach being obtained by applying a convex relaxation to the linearly constrained minimum variance approach.

The method according to the third aspect of the application can be performed by the sound processing node according to the first aspect of the application. Further features of the method according to the third aspect of the application result directly from the functionality of the sound processing node according to the first aspect of the application and its different implementation forms.

More specifically, in a first possible implementation form of the method according to the third aspect, the linearly constrained minimum variance approach is a robust linearly constrained minimum variance approach and the step of determining comprises the step of determining the plurality of weights using a transformed version of the robust linearly constrained minimum variance approach parametrized by a parameter $\alpha$, wherein the parameter $\alpha$ provides a tradeoff between the minimization of the magnitude of the weights and the energy of the beamforming signal.

This implementation form allows the processor to provide robust values for the plurality of weights by allowing an adjustment of the parameter $\alpha$.

In a second possible implementation form of the method according to the first implementation form of the third aspect, the step of determining comprises the step of determining the plurality of weights using the transformed version of the robust linearly constrained minimum variance approach on the basis of the following equation and constraints:

$$\min \sum_{i\in V}\sum_{l=1}^{M} \frac{1}{2NM} t_i^{(l)*} t_i^{(l)} + \frac{\alpha}{2} w_i^H w_i$$

$$\text{s.t.} \sum_{i\in V} D_i^{(p)H} w_i = s^{(p)} \ \forall\, p = 1, \ldots, P$$

$$\sum_{i\in V} t_i^{(l)} = \sum_{i\in V} N Y_i^{(l)H} w_i \ \forall\, l = 1, \ldots, M,$$

wherein $w_i$ denotes the i-th weight of the plurality of weights, $Y_i^{(l)}$ denotes the vector of sound signals received by i-th sound processing node in the frequency domain, V denotes the set of all sound processing nodes, M denotes the total number of microphones of all sound processing nodes, i.e. $M=\Sigma_{i=1}^{N} m_i$, N denotes the total number of sound processing nodes, $D_i^{(p)}$ defines a channel vector associated with a p-th direction, P denotes the total number of directions and $s^{(p)}$ denotes the desired response for the p-th direction.

This implementation form allows for an efficient determination of the plurality of weights defining the beamforming signal by the processor of the sound processing node.

In a third possible implementation form of the method according to the first implementation form of the third aspect, the step of determining comprises the step of determining the plurality of weights using a further transformed version of the linearly constrained minimum variance approach, the further transformed version of the linearly constrained minimum variance approach being obtained by further transforming the transformed version of the linearly constrained minimum variance approach to the dual domain.

By exploiting strong duality this implementation form allows for an efficient determination of the plurality of weights defining the beamforming signal by the processor of the sound processing node.

In a fourth possible implementation form of the method according to the third implementation form of the third aspect, the step of determining comprises the step of determining the plurality of weights using the further transformed version of the linearly constrained minimum variance approach on the basis of the following equation using the dual variable $\lambda$:

$$\min \sum_{i\in V}\left(\frac{1}{2}\lambda^H (B_i^H A_i^{-1} B_i)\lambda - \lambda^H C\right),$$

wherein the plurality of weights $w_i$ are defined by a vector $y_i$ defined by the following equation:

$$y_i t_i^{(1)}, t_i^{(2)}, \ldots, t_i^{(M)}, w_i^{(1)}, w_i^{(2)}, \ldots, w_i^{(m_i)}]^T,$$

wherein $$t_j^{(l)} = \Sigma_{i\in V} Y_i^{(l)H} w_i,$$

$Y_i^{(l)}$ denotes the vector of sound signals received by i-th sound processing node in the frequency domain, V denotes the set of all sound processing nodes, $m_i$ denotes the number of microphones of the i-th sound processing node, and the dual variable $\lambda$ is related to the vector $y_i$ by means of the following equation:

$$y_i^* = A_i^{-1} B_i^* \lambda^*$$

and wherein $A_i$, $B_i$ and C are defined by the following equations:

$$A_i = \mathrm{diag}\left(\left[\frac{1}{NM}, \frac{1}{NM}, \ldots, \frac{1}{NM}, \alpha, \alpha, \ldots, \alpha\right]^T\right)$$

$$B_i = \begin{pmatrix} -1 & 0 & \cdots & 0 & 0 & \cdots & 0 \\ 0 & -1 & \cdots & 0 & 0 & \cdots & 0 \\ \vdots & \vdots & \ddots & \vdots & \vdots & \ddots & \vdots \\ 0 & 0 & \cdots & -1 & 0 & \cdots & 0 \\ NY_i^{(1)} & NY_i^{(2)} & \cdots & NY_i^{(m_i)} & D_i^{(1)} & \cdots & D_i^{(P)} \end{pmatrix}$$

$$C = \left[0, 0, \ldots, 0, \frac{s^{(1)}}{N}, \frac{s^{(2)}}{N}, \ldots, \frac{s^{(p)}}{N}\right]^T$$

wherein

N denotes the total number of sound processing nodes,

M denotes the total number of microphones of all sound processing nodes, i.e. $M=\Sigma_{i=1}^{N} m_i$, $D_i^{(p)}$ defines a channel vector associated with a p-th direction, P denotes the total number of directions and $s^{(p)}$ denotes the desired response for the p-th direction.

This implementation form allows for an efficient determination of the plurality of weights defining the beamforming signal by the processor of the sound processing node, because the optimal $\lambda$ can be determined by inverting a (M+P) dimensional matrix which, for large arrangements of sound processing nodes, is much smaller than the N dimension matrix needed by conventional approaches.

In a fifth possible implementation form of the method of the third implementation form of the third aspect, the step of determining comprises the step of determining the plurality of weights using the further transformed version of the linearly constrained minimum variance approach on the basis of the following equation and the following constraint using the dual variable $\lambda$:

$$\min. \sum_{i \in V} \left(\frac{1}{2}\lambda_i^H (B_i^H A_i^{-1} B_i)\lambda_i - \lambda_i^H C\right)$$

$$\text{s.t. } D_{ij}\lambda_i + D_{ji}\lambda_j = 0 \ \forall (i, j) \in E,$$

wherein $\lambda_i$ defines a local estimate of the dual variable $\lambda$ at the i-th sound processing node, $D_{ij}=D_{ji}=\pm I$ with I denoting the identity matrix, E defines the set of sound processing nodes defining an edge of the arrangement of sound processing nodes and the plurality of weights $w_i$ are defined by a vector $y_i$ defined by the following equation:

$$y_i t_i^{(1)}, t_i^{(2)}, \ldots, t_i^{(M)}, w_i^{(1)}, w_i^{(2)}, \ldots, w_i^{(m_i)}]^T,$$

wherein $$t_j^{(l)} = \Sigma_{i \in V} Y_i^{(l)H} w_i,$$

$Y_i^{(l)}$ denotes the vector of sound signals received by i-th sound processing node in the frequency domain, V denotes the set of all sound processing nodes, $m_i$ denotes the number of microphones of the i-th sound processing node, and the dual variable $\lambda$ is related to the vector $y_i$ by means of the following equation:

$$y_i^* = A_i^{-1} B_i^* \lambda^*$$

and wherein $A_i$, $B_i$ and C are defined by the following equations:

$$A_i = \mathrm{diag}\left(\left[\frac{1}{NM}, \frac{1}{NM}, \ldots, \frac{1}{NM}, \alpha, \alpha, \ldots, \alpha\right]^T\right)$$

$$B_i = \begin{pmatrix} -1 & 0 & \cdots & 0 & 0 & \cdots & 0 \\ 0 & -1 & \cdots & 0 & 0 & \cdots & 0 \\ \vdots & \vdots & \ddots & \vdots & \vdots & \ddots & \vdots \\ 0 & 0 & \cdots & -1 & 0 & \cdots & 0 \\ NY_i^{(1)} & NY_i^{(2)} & \cdots & NY_i^{(m_i)} & D_i^{(1)} & \cdots & D_i^{(P)} \end{pmatrix}$$

$$C = \left[0, 0, \ldots, 0, \frac{s^{(1)}}{N}, \frac{s^{(2)}}{N}, \ldots, \frac{s^{(p)}}{N}\right]^T$$

wherein

N denotes the total number of sound processing nodes,

M denotes the total number of microphones of all sound processing nodes, i.e. $M=\Sigma_{i=1}^{N} m_i$, $D_i^{(p)}$ defines a channel vector associated with a p-th direction, P denotes the total number of directions and $s^{(p)}$ denotes the desired response for the p-th direction.

This implementation form is especially useful for arrangement of sound processing nodes defining an ad-hoc network of sound processing nodes, as new sound processing nodes can be added with only some of the rest of the nodes of the network having to be updated.

In a sixth possible implementation form of the method according to the fifth implementation form of the third aspect, the step of determining comprises the step of determining the plurality of weights on the basis of a distributed algorithm, in particular the primal dual method of multipliers.

This implementation form allows for a very efficient computation of the plurality of weights by the processor of a sound processing node of an arrangement of sound processing nodes defining a cyclic network topology.

In a seventh possible implementation form of the method according to the sixth implementation form of the third aspect, the step of determining comprises the step of determining the plurality of weights on the basis of a distributed algorithm by iteratively solving the following equations:

$$\lambda_{i,k+1} = \left(B_i^H A_i^{-1} + \sum_{j \in N(i)} R_{pij}\right)^{-1} \left(C + \sum_{j \in N(i)} (D_{ij}\varphi_{ji,k} + R_{pij}\lambda_{j,k})\right)$$

$$\varphi_{ij,k+1} = \varphi_{ji,k} - R_{pij}(D_{ij}\lambda_{i,k+1} + D_{ji}\lambda_{j,k})$$

wherein $\mathcal{N}$ (i) defines the set of sound processing nodes neighboring the i-th sound processing node and $R_{pij}$ denotes a positive definite matrix that determines the convergence rate and that is defined $\forall$(i, j)$\in$E by the following equation:

$$R_{pij} = \frac{1}{N}(B_i + B_j)^H A_i^{-1}(B_i + B_j).$$

This implementation form allows for an efficient computation of the plurality of weights by the processor of a sound processing node of an arrangement of sound processing nodes defining a cyclic network topology. In an implementation form, the sound processing node can be configured to distribute the variables $\lambda_{i,k+1}$ and $\varphi_{ij,k+1}$ to neighboring sound processing nodes via any wireless broadcast or directed transmission scheme.

In an eighth possible implementation form of the method according to the fifth implementation form of the third aspect, the step of determining comprises the step of determining the plurality of weights on the basis of a min-sum message passing algorithm.

This implementation form allows for an efficient computation of the plurality of weights by the processor of a sound processing node of an arrangement of sound processing nodes defining an acyclic network topology.

In a ninth possible implementation form of the method according to the eighth implementation form of the third aspect, the step of determining comprises the step of determining the plurality of weights on the basis of a min-sum message passing algorithm using the following equation:

$$\underset{\lambda_i}{\operatorname{argmin}}\left(\frac{1}{2}\lambda_i^H\left(B_i^H A_i^{-1} B_i + \sum_{j\in N(i)} m_{ji}\right)\lambda_i - N\lambda_i^H C\right),$$

wherein $m_{ji}$ denotes a message received by the sound processing node i from another sound processing node j and wherein the message $m_{ji}$ is defined by the following equation:

$$m_{ji} = B_j^H A_j^{-1} B_j + \sum_{k\in N(j),k\neq i} m_{kj},$$

wherein $\mathcal{N}$ (j) defines the set of sound processing nodes neighboring the j-th sound processing node.

This implementation form allows for a very efficient computation of the plurality of weights by the processor of a sound processing node of an arrangement of sound processing nodes defining an acyclic network topology. In an implementation form, the sound processing node can be configured to distribute the message $m_{ji}$ to neighboring sound processing nodes via any wireless broadcast or directed transmission scheme.

In a tenth possible implementation form of the method according to the third aspect as such or any one of the first to ninth possible implementation form thereof, the linearly constrained minimum variance approach is based on a covariance matrix R and the method comprises the further step of approximating the covariance matrix R using an unbiased covariance of the plurality of sound signals.

This implementation form allows for a distributed estimation of the covariance matrix, for instance, in the presence of time varying noise fields.

In an eleventh possible implementation form of the method according to the tenth implementation form of the third aspect, the unbiased covariance of the plurality of sound signals is defined by the following equation:

$$Q = \frac{1}{M}\sum_{l=1}^{M} Y^{(l)}Y^{(l)H},$$

wherein $Y_i^{(l)}$ denotes the vector of sound signals received by i-th sound processing node in the frequency domain and M denotes the total number of microphones of all sound processing nodes.

According to a fourth aspect the application relates to a computer program comprising program code for performing the method or any one of its implementation forms according to the third aspect of the application when executed on a computer.

The application can be implemented in hardware and/or software, and further, e.g. by a processor.

BRIEF DESCRIPTION OF THE DRAWINGS

Further embodiments of the application will be described with respect to the following figures, in which.

In the various figures, identical reference signs will be used for identical or at least functionally equivalent features.

DETAILED DESCRIPTION OF EMBODIMENTS

In the following detailed description, reference is made to the accompanying drawings, which form a part of the disclosure, and in which are shown, by way of illustration, specific aspects in which the present application may be practiced. It is understood that other aspects may be utilized and structural or logical changes may be made without departing from the scope of the present application. The following detailed description, therefore, is not to be taken in a limiting sense, as the scope of the present application is defined by the appended claims.

For instance, it is understood that a disclosure in connection with a described method may also hold true for a corresponding device or system configured to perform the method and vice versa. For example, if a specific method step is described, a corresponding device may include a unit to perform the described method step, even if such unit is not explicitly described or illustrated in the figures. Further, it is understood that the features of the various exemplary aspects described herein may be combined with each other, unless specifically noted otherwise.

Figure 1:
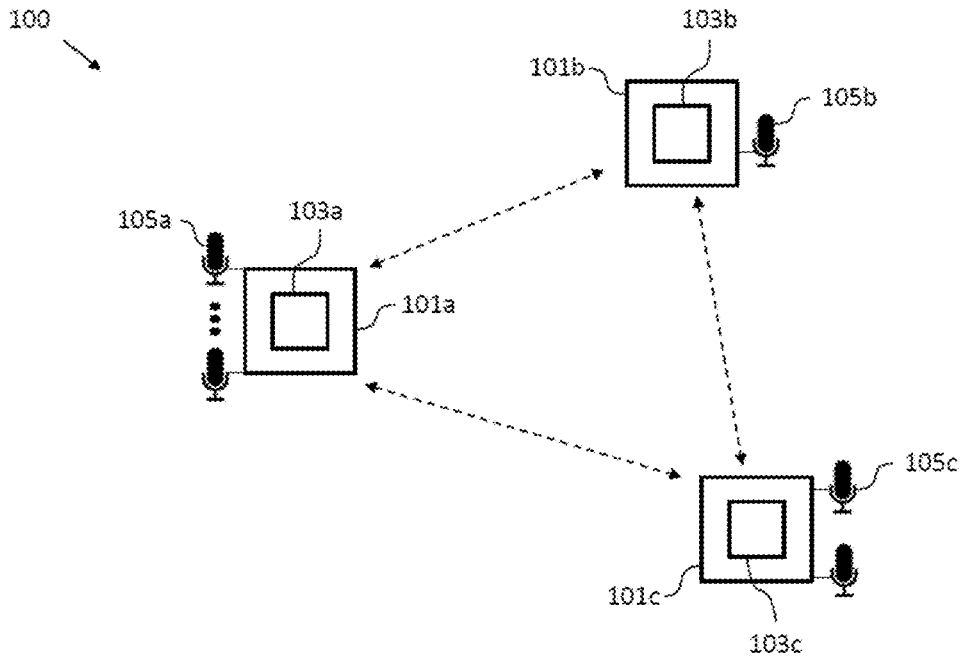
FIG. 1 shows a schematic diagram illustrating an arrangement of sound processing nodes according to an embodiment including a sound processing node according to an embodiment.

FIG. 1 shows an arrangement or system 100 of sound processing nodes 101*a-c* according to an embodiment including a sound processing node 101*a* according to an embodiment. The sound processing nodes 101*a-c* are configured to receive a plurality of sound signals form one or more target sources, for instance, speech signals from one or more speakers located at different positions with respect to the arrangement 100 of sound processing nodes. To this end, each sound processing node 101*a-c* of the arrangement 100 of sound processing nodes 101*a-c* can comprise one or more microphones 105*a-c*. In the exemplary embodiment shown in FIG. 1, the sound processing node 101*a* comprises more than two microphones 105*a*, the sound processing node 101*b* comprises one microphone 105*b* and the sound processing node 101*c* comprises two microphones.

In the exemplary embodiment shown in FIG. 1, the arrangement 100 of sound processing nodes 101*a-c* consists of three sound processing nodes, namely the sound processing nodes 101*a-c*. However, it will be appreciated, for instance, from the following detailed description that the present application also can be implemented in form of an arrangement or system of sound processing nodes having a smaller or a larger number of sound processing nodes. Save to the different number of microphones the sound processing nodes 101*a-c* can be essentially identical, i.e. all of the sound processing nodes 101*a-c* can comprise a processor 103*a-c* being configured essentially in the same way.

The processor 103*a* of the sound processing node 101*a* is configured to determine a beamforming signal on the basis of the plurality of sound signals weighted by a plurality of weights. The processor 103*a* is configured to determine the plurality of weights using a transformed version of a linearly constrained minimum variance approach, the transformed version of the linearly constrained minimum variance approach being obtained by applying a convex relaxation to the linearly constrained minimum variance approach.

Generally, the number of sound signals received by the sound processing node 101*a*, i.e. the number of microphones 105 of the sound processing node 101*a* determines the number of weights to be determined. The plurality of weights defining the beamforming signal are usually complex valued, i.e. including a time/phase shift. In an embodiment, the processor 103 is configured to determine the plurality of weights for a plurality of different frequency bins. In an embodiment, the beamforming signal is a sum of the sound signals received by the sound processing node 101*a* weighted by the plurality of weights. The linearly constrained minimum variance approach minimizes the noise power of the beamforming signal, while adhering to linear constraints which maintain desired responses for the plurality of sound signals. Using a convex relaxed version of the linearly constrained minimum variance approach allows processing by each node of the arrangement of sound processing nodes 101*a-c* in a fully distributed manner.

Figure 2:
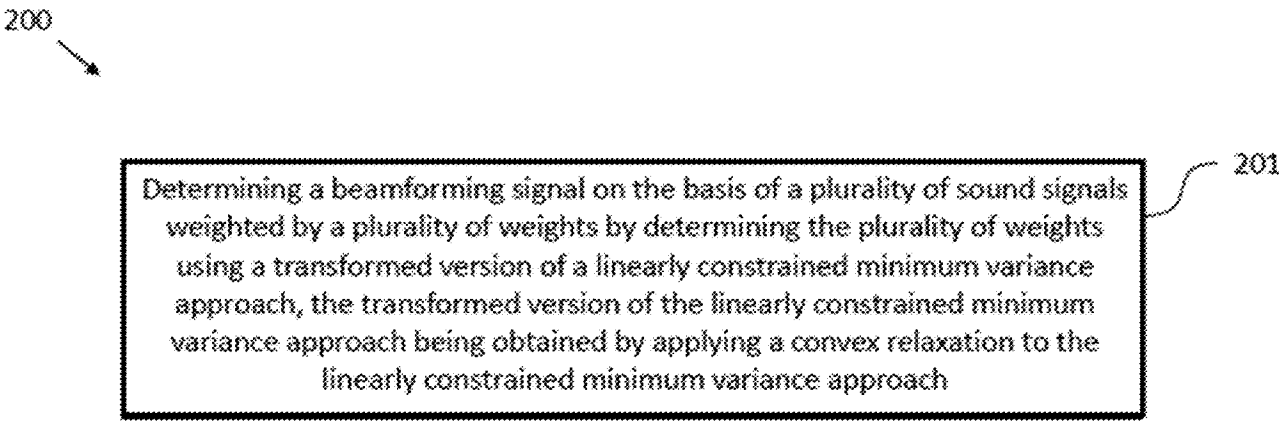
FIG. 2 shows a schematic diagram illustrating a method of operating a sound processing node according to an embodiment.

FIG. 2 shows a schematic diagram illustrating a method 200 of operating the sound processing node 101*a* according to an embodiment. The method 200 comprises a step 201 of determining a beamforming signal on the basis of a plurality of sound signals weighted by a plurality of weights by determining the plurality of weights using a transformed version of a linearly constrained minimum variance approach, the transformed version of the linearly constrained minimum variance approach being obtained by applying a convex relaxation to the linearly constrained minimum variance approach.

In the following, further implementation forms, embodiments and aspects of the sound processing node 101*a*, the arrangement 100 of sound processing nodes 101*a-c* and the method 200 will be described.

In an embodiment, the linearly constrained minimum variance approach is a robust linearly constrained minimum variance approach and wherein the processor is configured to determine the plurality of weights using a transformed version of the robust linearly constrained minimum variance approach parametrized by a parameter $\alpha$, wherein the parameter $\alpha$ provides a tradeoff between the minimization of the magnitude of the weights and the energy of the beamforming signal. Mathematically, the robust linearly constrained minimum variance approach parametrized by a parameter $\alpha$ for determining the plurality of weights for a particular frequency bin can be expressed in the form of an optimization problem as follows:

$$\begin{aligned} &\min.\ \frac{1}{2}w^H R w + \frac{\alpha}{2}w^H w \\ &\text{s.t. } D^H w = s \end{aligned} \tag{1}$$

where $R \in \mathbb{C}^{\mathcal{M}\times\mathcal{M}}$ is the covariance matrix, $D \in \mathbb{C}^{\mathcal{M}\times P}$ denotes a set of P channel vectors from particular directions defined by the target sources, $s \in \mathbb{C}^{P\times 1}$ is the desired response in those directions, $w \in \mathbb{C}^{\mathcal{M}\times 1}$ is a weight vector having as components the plurality of weights to be determined and $\mathcal{M}$ denotes to the total number of microphones 105*a-c* of the sound processing nodes 101*a-c*. It will be appreciated that in the limit $\alpha \to 0$ the robust linearly constrained minimum variance approach defined by equation (1) turns into the linearly constrained minimum variance approach.

As information about the true covariance matrix R might not always be available, in an embodiment the processor 103*a* is configured to approximate the covariance matrix R using an unbiased covariance of the plurality of sound signals. In an embodiment, the unbiased covariance of the plurality of sound signals is defined by the following equation:

$$Q = \frac{1}{M}\sum_{l=1}^{M} Y^{(l)}Y^{(l)H}, \tag{2}$$

wherein $Y^{(l)}$ denotes the vector of sound signals received by the sound processing nodes 101*a-c* and M denotes the total number of microphones 105*a-c* of the sound processing nodes 101*a-c*. Each $Y^{(l)}$ may represent a noisy or noiseless frame of frequency domain audio. In practical applications, due to the length of each frame of audio (~20 ms), in addition to the time varying nature of the noise field, it is often only practical to use a very small number of frames before they become significantly uncorrelated. Thus, in an embodiment each $Y^{(l)}$ can represent a noisy frame of audio containing both the target source speech as well as any interference signals. In an embodiment, M can be restricted to approximately 50 frames which implies that the noise field is "stationary" for at least half a second (due a frame overlap of 50%). In many scenarios, significantly less frames may be able to be used due to quicker variance in the noise field, such as one experiences when driving in a car.

By splitting the objective and constraints over the set of node based variables (denoted by a subscript i) equation 1 can be rewritten as:

$$\min.\ \frac{1}{2M}\sum_{l=1}^{M} w^H Y^{(l)}Y^{(l)H} w + \frac{\alpha}{2}\sum_{i\in V} w_i^H w_i \tag{3}$$

-continued $$\text{s.t.} \sum_{i\in V} D_i^{(p)H} w_i = s^{(p)} \ \forall\, p = 1, \ldots, P$$

where $w_i \in \mathbb{C}^{m_i \times 1}$ and $m_i$ denotes the number of microphones at sound processing node i. By introducing additional NM variables, $t_i^{(l)} = \Sigma_{i\in V} Y_i^{(l)H} w_i \forall i \in V$, l=1, . . . , M, equation 3 can be written as a distributed optimization problem of the form:

$$\begin{aligned} &\min. \sum_{i\in V}\sum_{l=1}^{M} \frac{1}{2NM} t_i^{(l)*} t_i^{(l)} + \frac{\alpha}{2} w_i^H w_i \\ &\text{s.t.} \sum_{i\in V} D_i^{(p)H} w_i = s^{(p)} \ \forall\, p = 1, \ldots, P \\ &t_i^{(l)} = \sum_{j\in V} Y_j^{(l)H} w_j \ \forall\, i \in V, l = 1, \ldots, M \end{aligned} \tag{4}$$

where $Y_i^{(l)} \in \mathbb{C}^{\mu_i \times 1}$ denotes the vector of sound signal measurements made at sound processing node i during audio frame 1. This step, although dramatically increasing the dimension of the approach allows distributing the approach. However, this increase in dimension can be addressed by embodiments of the application in part by using a tight convex relaxation.

The Lagrangian of the primal problem defined by equation 4 has the following form:

$$\begin{aligned} &\mathcal{L}(t, w, v) = \\ &\sum_{i\in V}\left(\sum_{l=1}^{M}\left(\frac{1}{2MN} t_i^{(l)*} t_i^{(l)} - \sum_{j\in V}\left(v_j^{(l)*} Y_i^{(l)H} w_i\right) - v_i^{(l)*} t_i^{(l)}\right) + \frac{\alpha}{2} w_i^H w_i - \right. \\ &\qquad \left. \sum_{p=1}^{P} \mu^{(p)*}\left(D_i^{(p)H} w_i - \frac{s^{(p)}}{N}\right)\right) \end{aligned} \tag{5}$$

where $v_j^{(l)}$ are the dual variables associated with each $t_j^{(l)} = \Sigma_{i\in V} Y_i^{(l)} w_i$ and $\mu^{(p)}$ is the dual variable associated with the constraint $\Sigma_{i\in V} D_i^{(p)H} w_i = s^{(p)}$. As the primal problem is convex and explicitly feasible, the present application proposes to solve this problem in the dual domain by exploiting strong duality. Taking complex partial derivatives with respect to each $t_j^{(l)}$ one finds that:

$$\begin{aligned} &\frac{\delta}{\delta t_i^{(l)}} \mathcal{L}(t, w, v) = \frac{1}{MN} t_i^{(l)*} + v_i^{(l)*} \\ &\therefore t_i^{(l)} = -NMv_i^{(l)} \end{aligned} \tag{6}$$

For a solution point to be primal feasible then each $t_j^{(l)} = t_i^{(l)} = t^{(l)} = \Sigma_{i\in V} Y_i^{(l)H} w_i$. Thus at optimality $v_j^{(l)} = v_i^{(l)} = \hat{v}^{(l)}$, where $\hat{v}^{(l)}$ denotes the optimal dual variable. By restricting the form of the dual variables such that all $v_i^{(l)} = \hat{v}^{(l)} \forall i \in V$, one retains the same optimal solution at consensus whilst reducing the number of dual variables which need to be introduced. This allows one to construct an equivalent primal Lagrangian of the form:

$$\begin{aligned} &\mathcal{L}(t, w, v) = \sum_{i\in V}\left(\sum_{l=1}^{M}\left(\frac{1}{2MN} t_i^{(l)*} t_i^{(l)} - v^{(l)*}\left(NY_i^{(l)H} w_i - t_i^{(l)}\right)\right) + \right. \\ &\qquad \left. \frac{\alpha}{2} w_i^H w_i - \sum_{p=1}^{P} \mu^{(p)H}\left(D_i^{(p)H} w_i - \frac{s^{(p)}}{N}\right)\right) \end{aligned} \tag{7}$$

Thus, it is possible to construct an equivalent convex optimization problem to that in equation 5 which only introduces M dual constraints. This has the form:

$$\begin{aligned} &\min. \sum_{i\in V}\sum_{l=1}^{M} \frac{1}{2NM} t_i^{(l)*} t_i^{(l)} + \frac{\alpha}{2} w_i^H w_i \\ &\text{s.t.} \sum_{i\in V} D_i^{(p)H} w_i = s^{(p)} \ \forall\, p = 1, \ldots, P \\ &\sum_{i\in V} t_i^{(l)} = \sum_{i\in V} NY_i^{(l)H} w_i \ \forall\, l = 1, \ldots, M \end{aligned} \tag{8}$$

Thus, in an embodiment the processor 103*a* of the sound processing node 101*a* is configured to determine the plurality of weights $w_i$ on the basis of equation 8.

Above equation 8 can be rewritten in the following form:

$$\begin{aligned} &\min. \sum_{i\in V} \frac{1}{2} y_i^H A_i y_i \\ &\text{s.t.} \sum_{i\in V} (B_i^H y_i - C) = 0 \\ &\text{where} \\ &y_i = \left[t_i^{(1)}, t_i^{(2)}, \ldots, t_i^{(M)}, w_i^{(1)}, w_i^{(2)}, \ldots, w_i^{(m_i)}\right]^T \\ &A_i = \operatorname{diag}\left(\left[\frac{1}{NM}, \frac{1}{NM}, \ldots, \frac{1}{NM}, \alpha, \alpha, \ldots, \alpha\right]^T\right) \\ &B_i = \begin{pmatrix} -1 & 0 & \cdots & 0 & 0 & \cdots & 0 \\ 0 & -1 & \cdots & 0 & 0 & \cdots & 0 \\ \vdots & \vdots & \ddots & \vdots & \vdots & \ddots & \vdots \\ 0 & 0 & \cdots & -1 & 0 & \cdots & 0 \\ NY_i^{(11)} & NY_i^{(21)} & \cdots & NY_i^{(m_i 1)} & D_i^{(11)} & \cdots & D_i^{(P1)} \\ \vdots & \vdots & \ddots & \vdots & \vdots & \ddots & \vdots \\ NY_i^{(1m_i)} & NY_i^{(2m_i)} & \cdots & NY_i^{(m_i m_i)} & D_i^{(1m_i)} & \cdots & D_i^{(Pm_i)} \end{pmatrix} \\ &C = \left[0, 0, \ldots, 0, \frac{s^{(1)}}{N}, \frac{s^{(2)}}{N}, \ldots, \frac{s^{(p)}}{N}\right]^T \end{aligned} \tag{9, 10}$$

with a primal Lagrangian given by:

$$\mathcal{L}(y, \lambda) = \sum_{i\in V}\left(\frac{1}{2} y_i^H A_i^{-1} y_i - \lambda^H (B_i^H y_i) + \lambda^H C\right) \tag{11}$$

In an embodiment, the matrix $B_i$ can also be written in the following simplified way:

$$B_i = \begin{pmatrix} -1 & 0 & \cdots & 0 & 0 & \cdots & 0 \\ 0 & -1 & \cdots & 0 & 0 & \cdots & 0 \\ \vdots & \vdots & \ddots & \vdots & \vdots & \ddots & \vdots \\ 0 & 0 & \cdots & -1 & 0 & \cdots & 0 \\ NY_i^{(1)} & NY_i^{(2)} & \cdots & NY_i^{(m_i)} & D_i^{(1)} & \cdots & D_i^{(P)} \end{pmatrix}$$

The dual problem can be found by calculating the complex partial derivatives of equation 11 with respect to each $y_i$ and equating these derivatives to 0, i.e.

$$\frac{\delta}{\delta t_i^{(l)}} \mathcal{L}(y, \lambda) = A_i y_i^* - B_i \lambda^* = 0 \qquad (12)$$

$$\therefore y_i^* = A_i^{-1} B_i^* \lambda^*$$

The resulting dual problem can be therefore shown to be:

$$\min. \sum_{i \in V} \left( \frac{1}{2} \lambda^H (B_i^H A_i^{-1} B_i) \lambda - \lambda^H C \right) \qquad (13)$$

Thus, in an embodiment the processor 103*a* of the sound processing node 101*a* is configured to determine the plurality of weights $w_i$ on the basis of equations 13, 12 and 10. Given equation 13 the optimal $\lambda$ can be found by inverting a (M+P) dimension matrix which, for arrangements with a large number of sound processing nodes, is much smaller than the N dimension matrix usually needed. As the inversion of a dimension D matrix is a $O(D^3)$ operation embodiments of the present application also provides a considerable reduction in computational complexity when M+P<N.

By introducing local estimates $\lambda_i$ at each sound processing node 101*a-c* and adding the constraint that along each edge of the arrangement 100 of sound processing nodes $\lambda_i = \lambda_j$ should hold, equation 13 can be shown to be equivalent to the following distributed optimization problem:

$$\min. \sum_{i \in V} \left( \frac{1}{2} \lambda_i^H (B_i^H A_i^{-1} B_i) \lambda_i - \lambda_i^H C \right) \qquad (14)$$

$$\text{s.t. } D_{ij} \lambda_i + D_{ji} \lambda_j = 0 \ \forall (i, j) \in E$$

Thus, in an embodiment the processor 103*a* of the sound processing node 101*a* is configured to determine the plurality of weights $w_i$ on the basis of equations 14, 12 and 10. In this case the restriction $D_{ij} = -D_{ji} = \pm I$ is made, where I denotes the identity matrix. It should be noted that the edges of the corresponding arrangement 100 of sound processing nodes 101*a-c* can be completely self-configuring and not known to anyone except for the sound processing nodes at either end of them. Thus, in an embodiment a sound processing node simply can monitor from which other sound processing nodes it can receive packets from (given a particular transmission range and/or packet quality) and from this infers who its neighboring sound processing nodes are independent of the remainder of the network structure defined by the arrangement 100 of sound processing nodes. This is particularly useful for an ad-hoc formation of a network of sound processing nodes as new sound processing nodes can be added to the network without the remainder of the network needing to be updated in any way.

If in alternative embodiments greater restrictions on the network topology, such as an acyclic or tree shaped topology, are to be imposed, additional "offline" processing prior to the use of the arrangement 100 of sound processing nodes 101*a-c* might become necessary.

One of the major benefits of the above described embodiments in comparison to conventional approaches is that they provide a wide range of flexibility in terms of how to solve the distributed problem as well any of the aforementioned restrictions to be imposed upon the underlying network topology of the arrangement 100 of sound processing nodes 101*a-c*. For instance, the most general class of undirected network topologies is those which may contain cyclic paths, a common feature in wireless sensor networks particularly when ad-hoc network formation methods are used. In contrast to conventional optimal distributed approaches, where cyclic network topologies are often ignored, the introduction of cycles has no effect on the ability of the different embodiments disclosed herein to solve the robust LCMV problem. For instance, the problem defined by equation 14 is in a standard form to be solved by a distributed algorithm such as the primal dual method of multipliers (BiADMM), as described in Zhang, Guoqiang, and Richard Heusdens, "Bi-alternating direction method of multipliers over graphs" in Acoustics, Speech and Signal Processing (ICASSP), 2015 IEEE International Conference, pp. 3571-3575, IEEE, 2015. Therefore, using a simplified dual update method it can be shown that one way to iteratively solve equation 14 in cyclic networks of sound processing nodes 101*a-c* is given by a BiADMM update scheme defined as:

$$\lambda_{i,k+1} = \underset{\lambda_i}{\operatorname{argmin}} \left( \frac{1}{2} \lambda_i^H (B_i^H A_i^{-1} B_i) \lambda_i - \lambda_i^H C + \sum_{j \in N(i)} \left( \varphi_{ji,k}^H D_{ij}^H \lambda_i + \frac{1}{2} (\lambda_i - \lambda_{j,k})^H R_{pij} (\lambda_i - \lambda_{j,k}) \right) \right) \qquad (15)$$

$$= \left( B_i^H A_i^{-1} B_i + \sum_{j \in N(i)} R_{pij} \right)^{-1} \left( C + \sum_{j \in N(i)} (D_{ij} \varphi_{ji,k} + R_{pij} \lambda_{j,k}) \right)$$

$$\varphi_{ij,k+1} = \varphi_{ji,k} - R_{pij} (D_{ij} \lambda_{i,k+1} + D_{ji} \lambda_{j,k})$$

wherein $\mathcal{N}$ (i) defines the set of sound processing nodes neighboring the i-th sound processing node and $R_{pij}$ denotes a positive definite matrix that determines the convergence rate and that is defined ∀(i,j)∈E by the following equation:

$$R_{pij} = \frac{1}{N}(B_i + B_j)^H A_i^{-1}(B_i + B_j). \tag{16}$$

Thus, in an embodiment the processor 103*a* of the sound processing node 101*a* is configured to determine the plurality of weights on the basis of iteratively solving equations 15.

Figure 3:
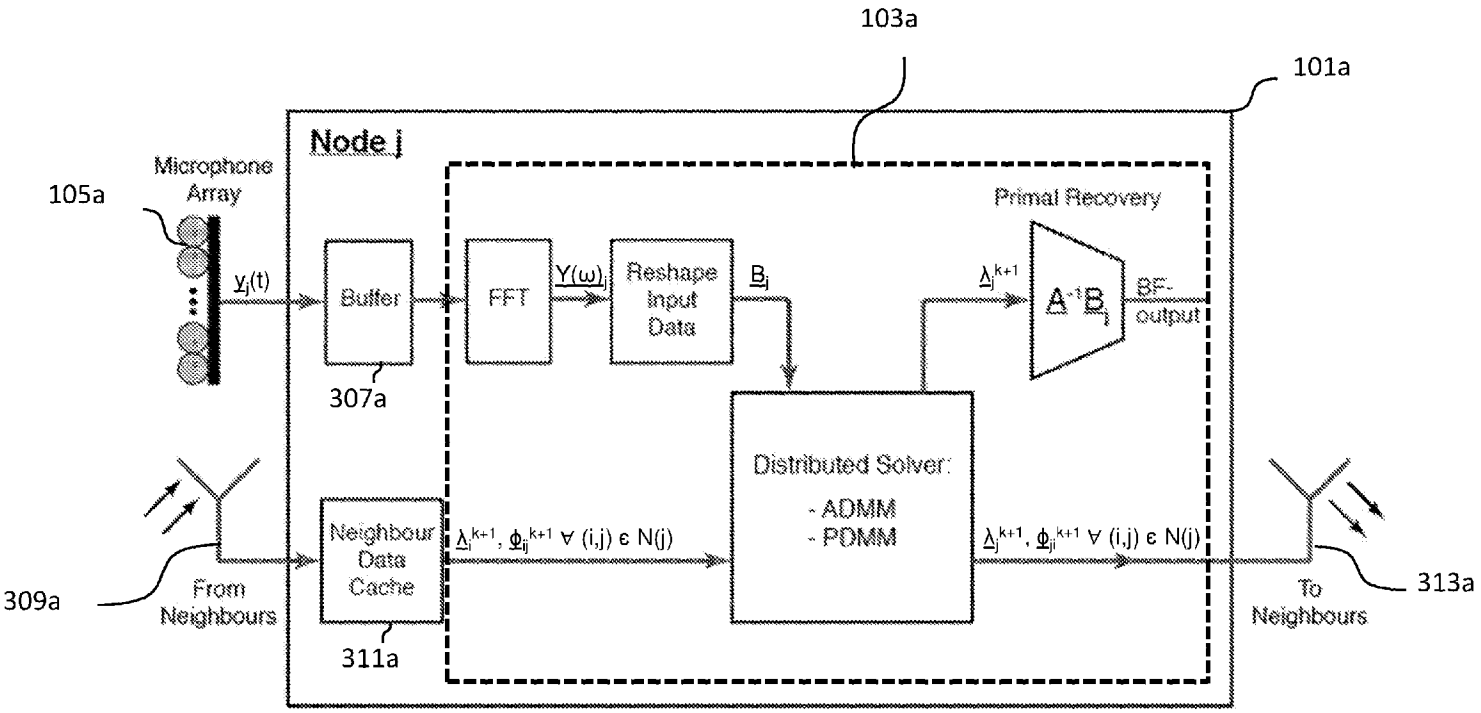
FIG. 3 shows a schematic diagram of a sound processing node according to an embodiment.

FIG. 3 shows a schematic diagram of an embodiment of the sound processing node 101*a* with a processor 103*a* that is configured to determine the plurality of weights on the basis of iteratively solving equations 15, i.e. using, for instance, the primal dual method of multipliers (BiADMM) or the alternating direction method of multipliers (ADMM).

In the embodiment shown in FIG. 3, the sound processing node 101*a* can comprise in addition to the processor 103*a* and the plurality of microphones 105*a*, a buffer 307*a* configured to storing at least portions of the sound signals received by the plurality of microphones 105*a*, a receiver 309*a* configured to receive variables from neighboring sound processing nodes for determining the plurality of weights, a cache 311*a* configured to store at least temporarily the variables received from the neighboring sound processing nodes and a emitter 313*a* configured to send variables to neighboring sound processing nodes for determining the plurality of weights.

In the embodiment shown in FIG. 3, the receiver 309*a* of the sound processing node 101*a* is configured to receive the variables $\lambda_{i,k+1}$ and $\varphi_{ij,k+1}$ as defined by equation 15 from the neighboring sound processing nodes and the emitter 313*a* is configured to send the variables as defined by equation 15 to the neighboring sound processing nodes. In an embodiment, the receiver 309*a* and the emitter 313*a* can be implemented in the form of a single communication interface.

As already described above, the processor 103*a* can be configured to determine the plurality of weights in the frequency domain. Thus, in an embodiment the processor 103*a* can be further configured to transform the plurality of sound signals received by the plurality of microphones 105*a* into the frequency domain using a Fourier transform.

In the embodiment shown in FIG. 3, the processor 103*a* of the sound processing node 101*a* is configured to compute for each iteration $\mathcal{N}$(i) dual variables and one primal variable, which involves the inversion of a M+P dimension matrix as the most expensive operation. However, if this inverted matrix is stored locally in the sound processing node 101*a*, as it does not vary between iterations, this can be reduced to a simply matrix multiplication. Additionally, in an embodiment the sound processing node 101*a* can be configured to transmit the updated variables for determining the plurality of weights to the neighboring sound processing nodes, for instance the sound processing nodes 101*b* and 101*c* shown in FIG. 1. In embodiments of the application, this can be achieved via any wireless broadcast or directed transmission scheme between the sound processing nodes. It should be noted however that BiADMM is inherently immune to packet loss so there is no need for handshaking routines if one is willing to tolerate the increased convergence time associated with the loss of packets. In an embodiment, the processor 103*a* is configured to run the iterative algorithm until convergence is achieved at which point the next block of audio can be processed.

In an alternative embodiment, especially suitable for enforcing a greater restriction on the topology of the network of sound processing nodes by removing the presence of all cyclic paths, an approach can be adopted which guarantees convergence within a finite number of transmissions between the sound processing nodes. This embodiment makes use of the fact that it is not necessary to store each $B_i^H A_i^{-1} B_i$ at every sound processing node to solve equation 13, rather only a global summation can be stored. Thus, by aggregating data along the network of sound processing nodes via a min-sum message passing algorithm, it is possible to uniquely reconstruct the global problem at each sound processing node using only locally transferred information. Thus, in an embodiment the processor of each sound processing node, for instance the processor 103*a* of the sound processing node 101*a*, is configured to generate the solution to the distributed problem by solving the following equation:

$$\underset{\lambda_i}{\operatorname{argmin}}\left(\frac{1}{2}\lambda_i^H\left(B_i^H A_i^{-1} B_i + \sum_{j\in N(i)} m_{ji}\right)\lambda_i - N\lambda_i^H C\right) \tag{17}$$

wherein each message from a sound processing node i to another sound processing node j is defined as:

$$m_{ij} = B_i^H A_i^{-1} B_i + \sum_{k\in N(i), k\neq j} m_{ki} \tag{18}$$

Each message is comprised of a (M+P) dimension positive semi-definite matrix which has only $$\frac{(M+P)^2}{2} + \frac{(M+P)}{2}$$

unique variables which need to be transmitted. However, by considering a parameterized form of each $B_i^H A_i^{-1} B_i$ where:

$$A_i^{-1} = \operatorname{diag}([a_1, a_2, \ldots, a_M, a_{M+1}, a_{M+2}, \ldots, a_{M+m_i}]^T) \tag{19}$$

$$B_i = \begin{pmatrix} -1 & 0 & \ldots & 0 & 0 & \ldots & 0 \\ 0 & -1 & \ldots & 0 & 0 & \ldots & 0 \\ \vdots & \vdots & \ddots & \vdots & \vdots & \ddots & \vdots \\ 0 & 0 & \ldots & -1 & 0 & \ldots & 0 \\ b_{11} & b_{21} & \ldots & b_{M1} & d_{11} & \ldots & d_{P1} \\ \vdots & \vdots & \ddots & \vdots & \vdots & \ddots & \vdots \\ b_{1m_i} & b_{2m_i} & \ldots & b_{m_i m_i} & d_{1m_i} & \ldots & d_{Pm_i} \end{pmatrix}$$

it can be shown that $$B_i^H A_i^{-1} B_i = \operatorname{diag}([a_1, a_2, \ldots, a_M, 0, 0, \ldots, 0]^T) + \beta \tag{20}$$

where

-continued $$\beta_{m,n} = \beta^*_{n,m} = \begin{cases} \sum_{k=1}^{m_i} a_{M+k} b^*_{nk} b_{mk} & \text{if } m, n \le M \\ \sum_{k=1}^{m_i} a_{M+k} b^*_{nk} d_{(m-M),k} & \text{if } M < m \le M+P, n \le M \\ \sum_{k=1}^{m_i} a_{M+k} d^*_{(n-M),k} b_{mk} & \text{if } M < n \le M+P, m \le M \\ \sum_{k=1}^{m_i} a_{M+k} d^*_{(n-M),k} d_{(m-M),k} & \text{if } M < m, n \le M+P \end{cases}$$

Therefore, due to the reuse of M−1 frames of data between audio blocks, only M+P new variables are introduced into the final matrix in the case of stationary target sources. This means that by reusing those values that are repeated the amount of data which needs to be transmitted between sound processing nodes can be reduced. If, however, varying target sources between blocks are allowed for as well, which may be the case if the location of a target source is estimated in real time, then a further $$P(M-1) + \frac{P^2}{2} + \frac{P}{2}$$

variables need to be transmitted resulting in a total of $$M(P+1) + \frac{P}{2}$$

values. Although this increases the number of values to transmit per node-to-node communication, one has the benefit that the min-sum algorithm in tree shaped graphs requires only 2N transmissions to reach consensus. This makes the acyclic message passing embodiment attractive in contrast to the iterative based embodiment described above, as we can exactly bound the time needed to reach consensus for each audio block and a known number of sound processing nodes.

Figure 4:
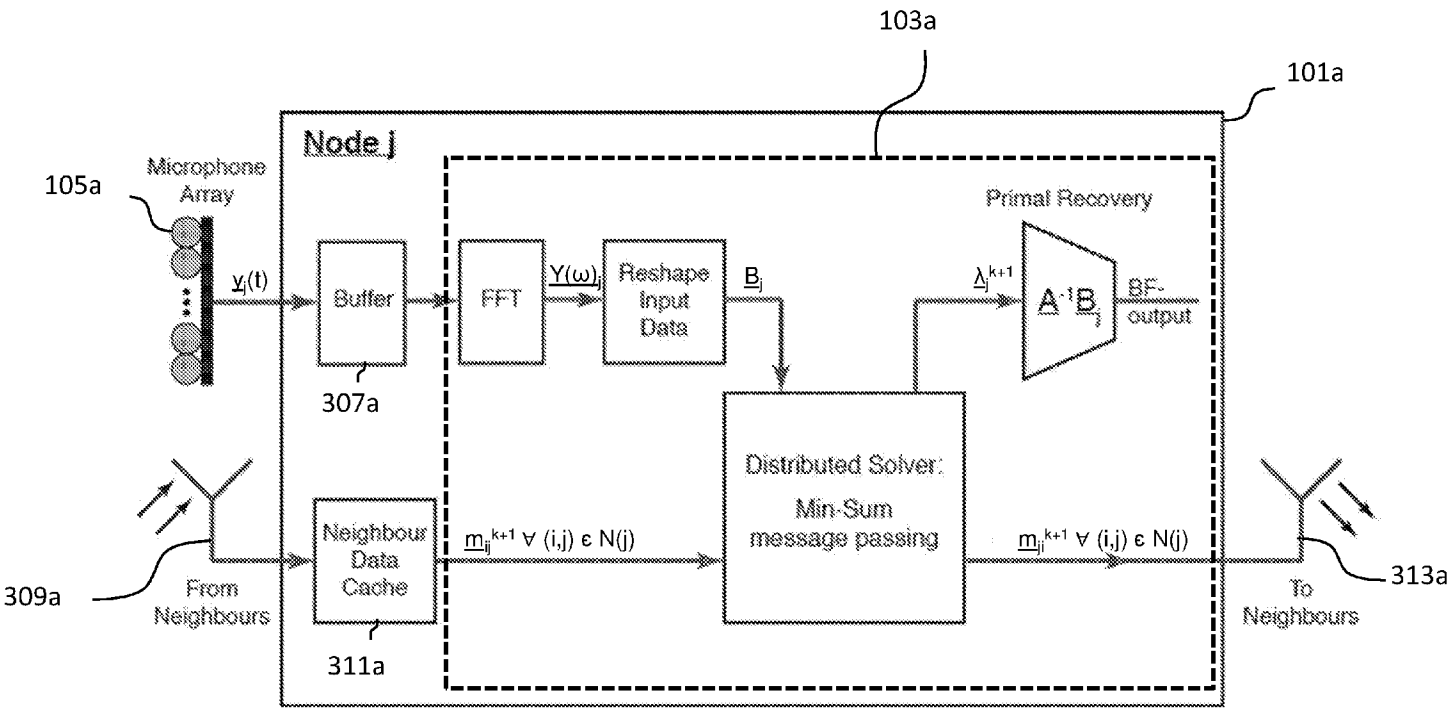
FIG. 4 shows a schematic diagram of a sound processing node according to an embodiment.

FIG. 4 shows a schematic diagram of an embodiment of the sound processing node 101*a* with a processor 103*a* that is configured to determine the plurality of weights on the basis of a min-sum message passage algorithm using, for instance, equations 17, 18 and 19.

In the embodiment shown in FIG. 4, the sound processing node 101*a* can comprise in addition to the processor 103*a* and the plurality of microphones 105*a*, a buffer 307*a* configured to storing at least portions of the sound signals received by the plurality of microphones 105*a*, a receiver 309*a* configured to receive variables from neighboring sound processing nodes for determining the plurality of weights, a cache 311*a* configured to store at least temporarily the variables received from the neighboring sound processing nodes and a emitter 313*a* configured to send variables to neighboring sound processing nodes for determining the plurality of weights.

In the embodiment shown in FIG. 4, the receiver 309*a* of the sound processing node 101*a* is configured to receive the messages as defined by equation 18 from the neighboring sound processing nodes and the emitter 313*a* is configured to send the message defined by equation 18 to the neighboring sound processing nodes. In an embodiment, the receiver 309*a* and the emitter 313*a* can be implemented in the form of a single communication interface.

As already described above, the processor 103*a* can be configured to determine the plurality of weights in the frequency domain. Thus, in an embodiment the processor 103*a* can be further configured to transform the plurality of sound signals received by the plurality of microphones 105*a* into the frequency domain using a Fourier transform.

Embodiments of the application can be implemented in the form of automated speech dictation systems, which are a useful tool in business environments for capturing the contents of a meeting. A common issue though is that as the number of users increases so does the noise within audio recordings due to the movement and additional talking that can take place within the meeting. This issue can be addressed in part through beamforming however having to utilize dedicated spaces equipped with centralized systems or attaching personal microphone to everyone to try and improve the SNR of each speaker can be an invasive and irritating procedure. In contrast, by utilizing existing microphones present at any meeting, namely those attached to the cellphones of those present, embodiments of the application can be used to form ad-hoc beamforming networks to achieve the same goal. Additionally the benefit of this type of approach is that it achieves a naturally scaling architecture as when more members are present in the meeting the number of nodes (cellphones) increases in turn. When combined with the network size independence of the embodiments of this application this leads to a very flexible solution to providing automated speech beamforming as a front end for automated speech dictation systems.

Figure 5:
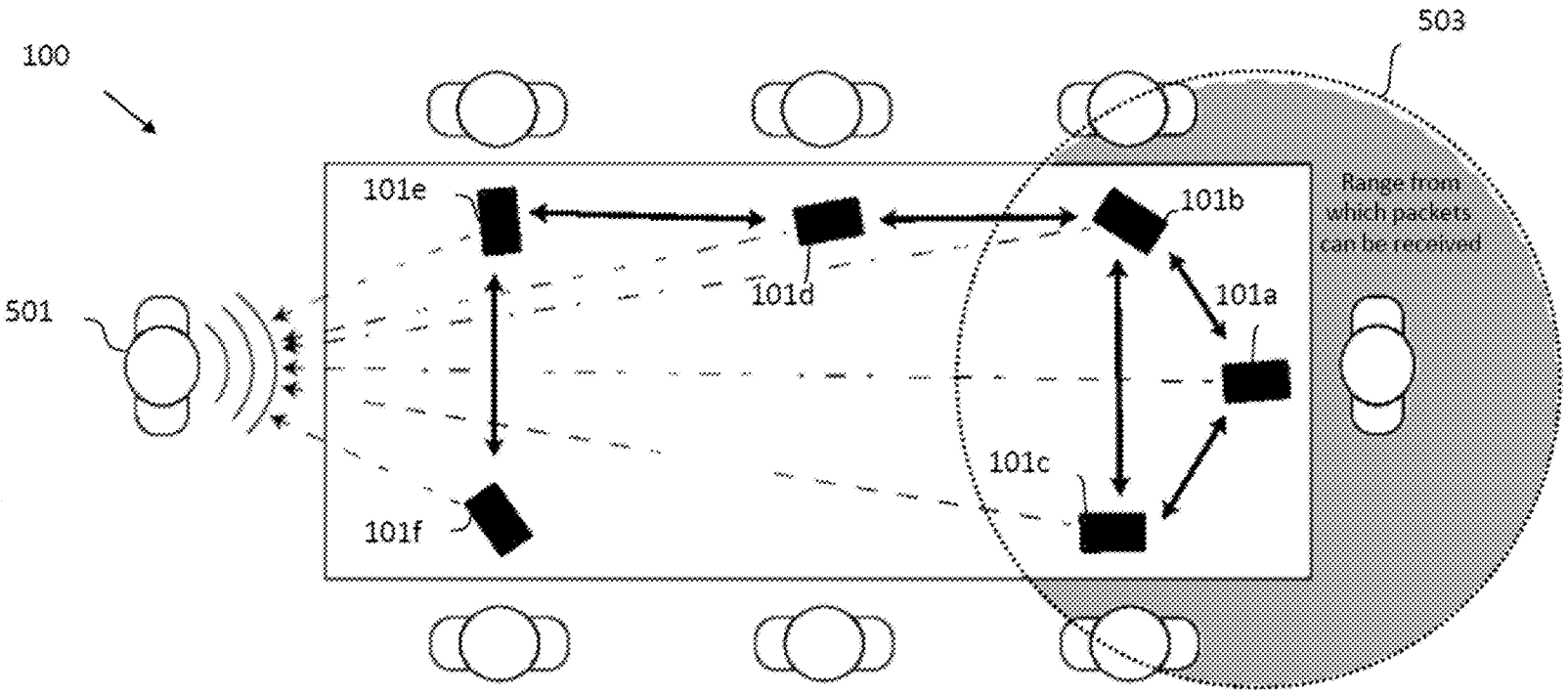
FIG. 5 shows a schematic diagram of an arrangement of sound processing nodes according to an embodiment.

FIG. 5 shows a further embodiment of an arrangement 100 of sound processing nodes 101*a-f* that can be used in the context of a business meeting. The exemplary six sound processing nodes 101*a-f* are defined by six cellphones 101*a-f*, which are being used to record and beamform the voice of the speaker 501 at the left end of the table. Here the dashed arrows indicate the direction from each cellphone, i.e. sound processing node, 101*a-f* to the target source and the solid double-headed arrows denote the channels of communication between the nodes 101*a-f*. The circle at the right hand side illustrates the transmission range 503 of the sound processing node 101*a* and defines the neighbor connections to the neighboring sound processing nodes 101*b* and 101*c*, which are determined by initially observing what packets can be received given the exemplary transmission range 503. As described in detail further above, these communication channels are used by the network of sound processing nodes 101*a-f* to transmit the estimated dual variables $\lambda_i$, in addition to any other node based variables relating to the chosen implementation of solver, between neighbouring nodes. This communication may be achieved via a number of wireless protocols including, but not limited to, LTE, Bluetooth and Wifi based systems, in case a dedicated node to node protocol is not available. From this process each sound processing node 101*a-f* can store a recording of the beamformed signal which can then be played back by any one of the attendees of the meeting at a later date. This information could also be accessed in "real time" by an attendee via the cellphone closest to him.

In the case of arrangement of sensor nodes in the form of fixed structure wireless sensor networks, embodiments of the application can provide similar transmission (and hence power consumption), computation (in the form of a smaller matrix inversion problem) and memory requirements as other conventional algorithms, which operate in tree type networks, while providing an optimal beamformer per block rather than converging to one over time. In particular, for arrangements with a large numbers of sound processing nodes, which may be used in the case of speech enhancement in large acoustic spaces, the above described embodiments especially suited for acyclic networks provide a significantly better performance than fully connected implementations of conventional algorithms. For this reason embodiments of the present application are a potential tool for any existing distributed beamformer applications where a block-optimal beamformer is desired.

Moreover, embodiments of the application provide amongst others for the following advantages. Embodiments of the application allow large scale WSNs to be used to solve robust LCMV problems in a fully distributed manner without the need to vary the operating platform given different network sizes. Embodiments of the application do not provide approximation of the robust LCMV solution as given the same input data, but rather solve the same problem as a centralized implementation. As the basis algorithm is a LCMV type beamformer, embodiments of the application gain the same increased flexibility noted over MVDR based methods by allowing for multiple constraint functions at one time. Additionally, as the covariance matrix can be re-estimated at each audio block, embodiments of the application can track non-stationary noise fields without additional modification. The non-scaling distributed nature provided by embodiments of the application makes it practical to design, at the hardware level, a sound processing node architecture which can be used for acoustic beam-forming via WSNs regardless of the scale of deployment needed. These sound processing nodes can also contain varying numbers of on node microphones which allows for the mixing and matching of different specification node architectures should networks need to be augmented with more nodes (assuming the original nodes are unavailable). The distributed nature of the arrangement of sound processing nodes provided by embodiments of the application also has the benefit of removing the need for costly centralized systems and the scalability issues associated with such components. Finally, the generalized nature of the distributed optimization formulation offers designers a wide degree of flexibility in how they choose to implement embodiments of the application. This allows them to trade off different performance metrics when choosing aspects such as the distributed solvers they want to use, the communication algorithms they implement between nodes or if they want to apply additional restrictions to the network topology to exploit finite convergence methods.

While a particular feature or aspect of the disclosure may have been disclosed with respect to only one of several implementations or embodiments, such feature or aspect may be combined with one or more other features or aspects of the other implementations or embodiments as may be desired and advantageous for any given or particular application. Furthermore, to the extent that the terms "include", "have", "with", or other variants thereof are used in either the detailed description or the claims, such terms are intended to be inclusive in a manner similar to the term "comprise". Also, the terms "exemplary", "for example" and "e.g." are merely meant as an example, rather than the best or optimal. The terms "coupled" and "connected", along with derivatives may have been used. It should be understood that these terms may have been used to indicate that two elements cooperate or interact with each other regardless whether they are in direct physical or electrical contact, or they are not in direct contact with each other.

Although specific aspects have been illustrated and described herein, it will be appreciated by those of ordinary skill in the art that a variety of alternate and/or equivalent implementations may be substituted for the specific aspects shown and described without departing from the scope of the present disclosure. This application is intended to cover any adaptations or variations of the specific aspects discussed herein.

Although the elements in the following claims are recited in a particular sequence with corresponding labeling, unless the claim recitations otherwise imply a particular sequence for implementing some or all of those elements, those elements are not necessarily intended to be limited to being implemented in that particular sequence.

Many alternatives, modifications, and variations will be apparent to those skilled in the art in light of the above teachings. Of course, those skilled in the art readily recognize that there are numerous applications of the application beyond those described herein. While the present application has been described with reference to one or more particular embodiments, those skilled in the art recognize that many changes may be made thereto without departing from the scope of the present application. It is therefore to be understood that within the scope of the appended claims and their equivalents, the application may be practiced otherwise than as specifically described herein.

What is claimed is:

1. A sound processing node for use in an arrangement of sound processing nodes, the arrangement of sound processing nodes configured to receive a plurality of sound signals, wherein the sound processing node comprises:

a processor configured to determine a beamforming signal based on the plurality of sound signals weighted by a plurality of weights, wherein the processor is configured to determine the plurality of weights using a transformed version of a linearly constrained minimum variance approach, the transformed version of the linearly constrained minimum variance approach being obtained by applying a convex relaxation to the linearly constrained minimum variance approach.

2. The sound processing node of claim 1, wherein the linearly constrained minimum variance approach is a robust linearly constrained minimum variance approach and wherein the processor is configured to determine the plurality of weights using a transformed version of the robust linearly constrained minimum variance approach parametrized by a parameter $\alpha$, wherein the parameter $\alpha$ provides a tradeoff between the minimization of the magnitude of the weights and the energy of the beamforming signal.

3. The sound processing node of claim 2, wherein the processor is configured to determine the plurality of weights using the transformed version of the robust linearly constrained minimum variance approach on the basis of the following equation and constraints:

$$\min. \quad \sum_{i\in V}\sum_{l=1}^{M}\frac{1}{2NM}t_i^{(l)*}t_i^{(l)}+\frac{\alpha}{2}w_i^H w_i$$

$$\text{s.t.} \quad \sum_{i\in V}D_i^{(p)H}w_i=s^{(p)} \quad \forall\, p=1,\ldots P$$

-continued $$\sum_{i\in V} t_i^{(l)} = \sum_{i\in V} NY_i^{(l)H} w_i \;\forall\, l = 1, \ldots M,$$

wherein $w_i$ denotes the i-th weight of the plurality of weights, $Y_i^{(l)}$ denotes the vector of sound signals received by i-th sound processing node, V denotes the set of all sound processing nodes, M denotes the total number of microphones of all sound processing nodes, i.e. $M=\Sigma_{i=1}^{N} m_i$, N denotes the total number of sound processing nodes, $D_i^{(p)}$ defines a channel vector associated with a p-th direction, P denotes the total number of directions and $s^{(p)}$ denotes the desired response for the p-th direction.

4. The sound processing node of claim 2, wherein the processor is configured to determine the plurality of weights using a further transformed version of the linearly constrained minimum variance approach, the further transformed version of the linearly constrained minimum variance approach being obtained by further transforming the transformed version of the linearly constrained minimum variance approach to the dual domain.

5. The sound processing node of claim 4, wherein the processor is configured to determine the plurality of weights using the further transformed version of the linearly constrained minimum variance approach on the basis of the following equation using the dual variable λ:

$$\min \sum_{i\in V}\left(\frac{1}{2}\lambda^H (B_i^H A_i^{-1} B_i)\lambda - \lambda^H C\right),$$

wherein the plurality of weights $w_i$ are defined by a vector $y_i$ defined by the following equation:

$$y_i=[t_i^{(1)}, t_i^{(2)}, \ldots, t_i^{(M)}, w_i^{(1)}, w_i^{(2)}, \ldots, w_i^{(m_i)}]^T,$$

wherein $$t_j^{(l)}=\Sigma_{i\in V} Y_i^{(l)H} w_i,$$

$Y_i^{(l)}$ denotes the vector of sound signals received by i-th sound processing node, V denotes the set of all sound processing nodes, $m_i$ denotes the number of microphones of the i-th sound processing node, and the dual variable λ is related to the vector $y_i$ by means of the following equation:

$$y^*_i=A_i^{-1}B^*_i\lambda^*$$

$$A_i = \mathrm{diag}\left(\left[\frac{1}{NM}, \frac{1}{NM}, \ldots, \frac{1}{NM}, \alpha, \alpha, \ldots, \alpha\right]^T\right)$$

$$B_i = \begin{pmatrix} -1 & 0 & \ldots & 0 & 0 & \ldots & 0 \\ 0 & -1 & \ldots & 0 & 0 & \ldots & 0 \\ \vdots & \vdots & \ddots & \vdots & \vdots & \ddots & \vdots \\ 0 & 0 & \ldots & -1 & 0 & \ldots & 0 \\ NY_i^{(1)} & NY_i^{(2)} & \ldots & NY_i^{(m_i)} & D_i^{(1)} & \ldots & D_i^{(P)} \end{pmatrix}$$

$$C = \left[0, 0, \ldots, 0, \frac{s^{(1)}}{N}, \frac{s^{(2)}}{N}, \ldots, \frac{s^{(P)}}{N}\right]^T$$

wherein

N denotes the total number of sound processing nodes,

M denotes the total number of microphones of all sound processing nodes, i.e. $M=\Sigma_{i=1}^{N} m_i$, $D_i^{(p)}$ defines a channel vector associated with a p-th direction, P denotes the total number of directions and $s^{(p)}$ denotes the desired response for the p-th direction.

6. The sound processing node of claim 4, wherein the processor is configured to determine the plurality of weights using the further transformed version of the linearly constrained minimum variance approach on the basis of the following equation and the following constraint using the dual variable λ:

$$\min \sum_{i\in V}\left(\frac{1}{2}\lambda_i^H (B_i^H A_i^{-1} B_i)\lambda_i - \lambda_i^H C\right),$$

$$\text{s.t. } D_{ij}\lambda_i + D_{ji}\lambda_j = 0 \;\forall\, (i, j) \in E$$

wherein

P1 $D_{ij}=-D_{ij}=\pm I$ with I denoting the identity matrix,

E defines the set of sound processing nodes defining an edge of the arrangement of sound processing nodes, $\lambda_i$ defines a local estimate of the dual variable λ for the i-th sound processing node under the constraint that along each edge $\lambda_i=\lambda_j$ and the plurality of weights $w_i$ are defined by a vector $y_i$ defined by the following equation:

$$y_i=[t_i^{(1)}, t_i^{(2)}, \ldots, t_i^{(M)}, w_i^{(1)}, w_i^{(2)}, \ldots, w_i^{(m_i)}]^T,$$

wherein $$t_j^{(l)}=\Sigma_{i\in V} Y_i^{(l)H} w_i,$$

$Y_i^{(l)}$ denotes the vector of sound signals received by i-th sound processing node, V denotes the set of all sound processing nodes, $m_i$ denotes the number of microphones of the i-th sound processing node, and the dual variable λ is related to the vector $y_i$ by means of the following equation:

$$y^*_i=A_i^{-1}B^*_i\lambda^*$$

and wherein $A_i$, $B_i$ and C are defined by the following equations:

$$A_i = \mathrm{diag}\left(\left[\frac{1}{NM}, \frac{1}{NM}, \ldots, \frac{1}{NM}, \alpha, \alpha, \ldots, \alpha\right]^T\right)$$

$$B_i = \begin{pmatrix} -1 & 0 & \ldots & 0 & 0 & \ldots & 0 \\ 0 & -1 & \ldots & 0 & 0 & \ldots & 0 \\ \vdots & \vdots & \ddots & \vdots & \vdots & \ddots & \vdots \\ 0 & 0 & \ldots & -1 & 0 & \ldots & 0 \\ NY_i^{(1)} & NY_i^{(2)} & \ldots & NY_i^{(m_i)} & D_i^{(1)} & \ldots & D_i^{(P)} \end{pmatrix}$$

$$C = \left[0, 0, \ldots, 0, \frac{s^{(1)}}{N}, \frac{s^{(2)}}{N}, \ldots, \frac{s^{(P)}}{N}\right]^T$$

wherein

N denotes the total number of sound processing nodes,

M denotes the total number of microphones of all sound processing nodes, i.e. $M=\Sigma_{i=1}^{N} m_i$, $D_i^{(p)}$ defines a channel vector associated with a p-th direction, P denotes the total number of directions and $s^{(p)}$ denotes the desired response for the p-th direction.

7. The sound processing node of claim 6, wherein the processor is configured to determine the plurality of weights on the basis of the primal dual method of multipliers.

8. The sound processing node of claim 7, wherein the processor is configured to determine the plurality of weights on the basis of a distributed algorithm by iteratively solving the following equations:

$$\lambda_{i,k+1} = \left(B_i^H A_i^{-1} B_i + \sum_{j \in N(i)} R_{pij}\right)^{-1} \left(C + \sum_{j \in N(i)} (D_{ij}\varphi_{ji,k} + R_{pij}\lambda_{j,k})\right)$$

$$\varphi_{ij,k+1} = \varphi_{ji,k} - R_{pij}(D_{ij}\lambda_{i,k+1} + D_{ji}\lambda_{j,k})$$

wherein $\mathcal{N}$ (i) defines the set of sound processing nodes neighboring the i-th sound processing node and $R_{pij}$ denotes a positive definite matrix that determines the convergence rate and that is defined $\forall(i,j) \in E$ by the following equation:

$$R_{pij} = \frac{1}{N}(B_i + B_j)^H A_i^{-1}(B_i + B_j).$$

9. The sound processing node of claim 6, wherein the processor is configured to determine the plurality of weights on the basis of a min-sum message passing algorithm.

10. The sound processing node of claim 9, wherein the processor is configured to determine the plurality of weights on the basis of a min-sum message passing algorithm using the following equation:

$$\underset{\lambda_i}{\operatorname{argmin}}\left(\frac{1}{2}\lambda_i^H\left(B_i^H A_i^{-1} B_i + \sum_{j \in N(i)} m_{ji}\right)\lambda_i - N\lambda_i^H C\right),$$

wherein $m_{ji}$ denotes a message received by the i-th sound processing node from another sound processing node j and wherein the message $m_{ji}$ is defined by the following equation:

$$m_{ji} = B_j^H A_j^{-1} B_j + \sum_{k \in N(j), k \neq i} m_{kj}.$$

wherein $\mathcal{N}$ (j) defines the set of sound processing nodes neighboring the j-th sound processing node.

11. The sound processing node of claim 1, wherein the linearly constrained minimum variance approach is based on a covariance matrix R and wherein the processor is configured to approximate the covariance matrix R using an unbiased covariance of the plurality of sound signals.

12. The sound processing node of claim 11, wherein the unbiased covariance of the plurality of sound signals is defined by the following equation:

$$Q = \frac{1}{M}\sum_{l=1}^{M} Y^{(l)} Y^{(l)H},$$

wherein $Y_i^{(l)}$ denotes the vector of sound signals received by i-th sound processing node and M denotes the total number of microphones of all sound processing nodes.

13. A sound processing system comprising a plurality of sound processing nodes according to claim 1, wherein the plurality of sound processing nodes are configured to exchange variables for determining the plurality of weights using a transformed version of the linearly constrained minimum variance approach.

14. A method of operating a sound processing node in an arrangement of sound processing nodes, the sound processing nodes configured to receive a plurality of sound signals, wherein the method comprises:

determining a beamforming signal on the basis of the plurality of sound signals weighted by a plurality of weights by determining the plurality of weights using a transformed version of a linearly constrained minimum variance approach, the transformed version of the linearly constrained minimum variance approach being obtained by applying a convex relaxation to the linearly constrained minimum variance approach.

15. A nontransitory computer-readable medium including computer-executable instructions for execution on a sound processing node, such that when the computer-executable instructions are executed by the sound processing node a method is carried out comprising:

determining a beamforming signal on the basis of the plurality of sound signals weighted by a plurality of weights by determining the plurality of weights using a transformed version of a linearly constrained minimum variance approach, the transformed version of the linearly constrained minimum variance approach being obtained by applying a convex relaxation to the linearly constrained minimum variance approach.

* * * * *